US006061304A

United States Patent [19]

Nagata et al.

[11] Patent Number: 6,061,304

[45] Date of Patent: May 9, 2000

[54] ELECTRONIC WATCH

[75] Inventors: Yoichi Nagata, Tokorozawa; Hisato Hiraishi, Tokyo, both of Japan

[73] Assignee: Citizen Watch Co., Ltd., Tokyo, Japan

[21] Appl. No.: 09/043,911

[22] PCT Filed: Jul. 31, 1997

[86] PCT No.: PCT/JP97/02671

§ 371 Date: Mar. 31, 1998

§ 102(e) Date: Mar. 31, 1998

[87] PCT Pub. No.: WO98/06013

PCT Pub. Date: Feb. 12, 1998

[30] Foreign Application Priority Data

Aug. 1, 1996 [JP] Japan ..... 8-203397
Jan. 14, 1997 [JP] Japan ..... 9-004480

[51] Int. Cl.[7] ..... G04B 1/00

[52] U.S. Cl. ..... 368/66; 368/204; 368/64

[58] Field of Search ..... 368/64, 68, 205, 368/204, 203

[56] References Cited

U.S. PATENT DOCUMENTS 4,099,372 7/1978 Beyers, Jr. ..... 368/187
4,182,110 1/1980 Kamiwaki et al. ..... 368/64
4,395,135 7/1983 Frantz ..... 368/63
4,634,953 1/1987 Shoji et al. ..... 320/1
4,702,613 10/1987 Ohtawa ..... 368/66

FOREIGN PATENT DOCUMENTS 62-242882 10/1987 Japan .
63-148193 6/1988 Japan .
4-81754 12/1992 Japan .
5-264751 10/1993 Japan .

*Primary Examiner*—Bernard Roskoski
*Attorney, Agent, or Firm*—Armstrong, Westerman, Hattori, McLeland & Naughton

[57] ABSTRACT

An electronic watch is provided with an electric power generator for generating electric energy by external energy, electric power charger for charging the electric energy generated by the electric power generator, a watch driving system comprising a watch driving circuit and a time display sub-system, operated by electric energy supplied by the electric power charger, a stored electric power detector for detecting an amount of electric energy charged in the electric power charger, and a controller. Operation of at least the time display sub-system of the watch driving system is suspended when the amount of electric energy stored as detected by the stored electric power detector falls below a preset standard value, and thereafter, operation of the suspended portion of the watch driving system is resumed upon detecting conditions for reactivation, such operation being continued at least for a period when preset conditions are met. Thus, when the electronic watch is put to use again after it is left unused for a long time, the watch driving system does not come to a stop immediately after resumption of operation of time display, ensuring stable display of time.

15 Claims, 9 Drawing Sheets

ELECTRONIC WATCH

TECHNICAL FIELD

The present invention relates to an electronic watch incorporating electric power generator by utilizing externally available energy, and storing the electric energy generated by the electric power generator, that is driven by the electric energy.

BACKGROUND TECHNOLOGY

There are electronic watches provided with a built-in electric power generator for displaying time by converting external energy such as photovoltaic energy, thermal energy, mechanical energy, and the like into electric energy (generation of power), and by driving a watch driving system with the use of the electric energy.

Among such electronic watches with the built-in electric power generator, there is a solar cell power generation watch for converting photovoltaic energy into electric energy by use of a solar cell, a mechanical energy conversion power generation watch for converting mechanical energy of the rotation of a rotary weight into electric energy, a temperature difference power generation watch for generating power by utilizing the difference in temperature between the opposite ends of each of integrated thermocouples, and the like.

It is essential for these electronic watches provided with the built-in electric power generator to be driven stably and continuously even in case the supply of external energy is cut off. Accordingly, these electronic watches are also provided with electric power storage means therein such as a secondary cell, a large capacity capacitor, or the like to store electric energy generated by the electric power generator when external energy is available so that the watches can be continuously driven by the electric energy stored in the electric power storage means when the electric power generator is unable to generate power.

This type of electronic watch with a built-in electric power generator has been disclosed in, for example, Japanese Patent Laid-open publication H 4-81754. FIG. 9 is a block diagram showing the general arrangement of the conventional electronic watch with the built-in electric power generator.

In the electronic watch shown in FIG. 9, a small capacitor 132 is connected in series with the electric power generator 130 by external energy, such as a solar cell or the like, via a diode 138 which is first reverse flow preventing means, and clock means 131 and a controller 140 are connected in parallel with the small capacitor 132. Further, a large capacitor 133 is connected in series with the electric power generator 130 via a charge switch 134 and a diode 139 which is second reverse flow preventing means.

A discharge switch 135 is interposed between the small capacitor 132 and the large capacitor 133. Further, first voltage detector 136 and second voltage detector 137 are connected to the small capacitor 132 and the large capacitor 133, respectively, so as to be able to detect terminal voltages of the respective capacitors.

In the electronic watch with the built-in electric power generator when the electric power generator 130 generates sufficient electric power, the clock means 131 is driven by the electric energy supplied thereby while the small capacitor 132 and the large capacitor 133 are charged also by the electric energy. However, when the electric power generator 130 is unable to generate electric power, the clock means 131 is driven continuously by electric energy stored in the capacitors.

When the amount of electric energy stored in the large capacitor 133 is small and the terminal voltage thereof is at a low level and the electric power generator is not generating electric power, the clock means 131 is deactivated owing to the small little amount of electric energy stored in the small capacitor 132, then the charge switch 134 and the discharge switch 135 are open.

When the electronic watch is in this state and the electric power generator 130 starts generation of electric power, electric energy generated is thereby accumulated only in the small capacitor 132, and consequently, the terminal voltage of the small capacitor 132 rises relatively quickly, enabling the clock means 131 to start in a short time after the electric power generator 130 starts to work.

However, even though the clock means 131 is activated by temporary generation of power as described above, there may arise a problem that the clock means 131 comes to a stop in a few seconds after using up a small amount of electric energy stored in the small capacitor 132 when the electric power generator 130 stops generation of power again in a short time.

It happens therefore that when a user attempts to set the electronic watch to right time after checking that a set of watch hands of the clock means 131 has started to move by initial charging of electric energy into the small capacitor 132, the hands comes almost immediately to stop.

Thus, the electronic watch even with the electric power storage means provided therein can not be driven continuously since electric energy stored in the electric power storage means is eventually used up in the case that external energy is not supplied for a long duration.

Even in such a case, the electronic watch can be driven if the electric power generator is caused to start generation of power by resuming supply of the external energy as described above.

In order to accumulate a sufficient amount of electric energy in the electric power storage means which has been once completely depleted to drive the electronic watch continuously, however, it is necessary to either increase the amount of external energy supplied per a unit hour, or prolong the duration of energy supply.

To either increase the amount of external energy supplied per an unit hour, or prolong the duration of energy supply causes a great burden to a user, and consequently, the commercial value of the electronic watch is considerably depreciated.

Furthermore, with some types of electronic watch, depending on the type of electric power generator by converting external energy into electric energy, for example, employing thermoelectric generator, it is impractical to increase the amount of external energy supplied per an unit hour.

Thus, with the conventional electronic watch provided with the built-in electric power generator, recharging the electric power storage means with a sufficient amount of electric energy involves various problems when the electric power storage means is substantially depleted. Since it is not easy to build up a sufficient amount of electric energy when the electric power storage means is substantially depleted as described above, a problem arises that driving of the electronic watch comes to a stop immediately upon stoppage in supply of external energy even for a short time if the electronic watch is activated when the electric power storage means is substantially depleted.

The present invention has been developed to overcome the problems described hereinbefore, and it is an object of the invention to provide an electronic watch with a built-in electric power generator wherein stable driving is effected regardless of variously varying conditions of usage, and particularly, when it is put to use again after being out of use for a relatively long period, starting operation of displaying time can be constantly continued.

DISCLOSURE OF THE INVENTION

To this end, an electronic watch according to the invention is provided with:

an electric power generator for generating electric energy by external energy, electric power storage means for storing the electric energy generated by the electric power generator, a watch driving system comprising a watch driving circuit and a time display sub-system, operated by electric energy supplied by the electric power storage means, a stored electric power detector for detecting an amount of electric energy stored in the electric power storage means, and a controller whereby operation of at least the time display sub-system of the watch driving system is suspended when the amount of electric energy stored as detected by the stored electric power detector falls below a preset standard value, and thereafter, operation of the suspended portion of the watch driving system is resumed upon detecting conditions for reactivation, such operation being continued at least for a period when preset conditions are met.

The electronic watch according to the invention may further comprise electric power generation detector for detecting a power generation condition of the electric power generator to cause the controller to suspend operation of at least the time display sub-system of the watch driving system when the amount of electric energy stored as detected by the stored electric power detector falls below the preset standard value, and an amount of electric energy generated by the electric power generator as detected by the electric power generation detector falls to a given level or lower.

The conditions for reactivation of the electronic watch as detected by the controller are established when the watch driving system is activated whereby a time is set with the time of day, when electric energy at a given level or higher is generated by the electric power generator, and the like.

After the conditions for reactivation are satisfied and operation of the suspended portion of the watch driving system is resumed, the preset conditions for allowing the resumed operation to continue may be set as until the elapse of a given time after resumption of the operation, or until the amount of electric energy stored as detected by the stored electric power detector falls below a new standard value set below the preset standard value, or the like.

Further, the controller may be provided with means such that the standard value is set by selecting any value among a plurality of standard values at various levels so that when the amount of electric energy stored as detected by the stored electric power detector falls below a standard value set, the operation of at least the time display sub-system of the watch driving system is suspended, and upon detecting the conditions for reactivation, operation of the suspended portion of the watch driving system is resumed, changing the standard value to a standard value at a level lower by one level than the previously set level, and the resumed operation is continued until the amount of electric energy stored as detected by the stored electric power detector falls below a changed standard value, and further when the amount of electric energy stored as detected exceeds a difference between a standard value at a level higher by one level than the changed standard value and the changed standard value by a given amount, the standard value is changed to a new standard value at a level higher by one level.

The controller may further comprise means for causing the time display sub-system to automatically set a time on display with the time of day when operation of the suspended portion of the watch driving system is resumed.

With the electronic watch according to the invention, if the standard value of the amount of electric energy stored, based on which at least the time display sub-system of the watch driving system is suspended by the controller, is set at a value having a margin of safety to enable the watch driving system to be driven for a short while, the electronic watch, wherein operation of time display has been suspended after being left unused for a relatively long time, can resume operation of the watch driving system when put to use again from such a condition by an action to set the watch right, or by the start of power generation by the electric power generator, and can continue operation by the electric energy still remaining in the electric power storage means for at least a given length of time, or until the amount of electric energy stored in the electric power storage means falls further by a given amount.

As a result, even if supply of external energy is cut off temporarily, operation of time display never comes to an immediate stop, ensuring stable operation of displaying an initial time.

BEST MODE FOR CARRYING OUT THE INVENTION

Embodiments of an electronic watch according to the invention will be described hereinafter with reference to the accompanying drawings.

First Embodiment

Figure 1:
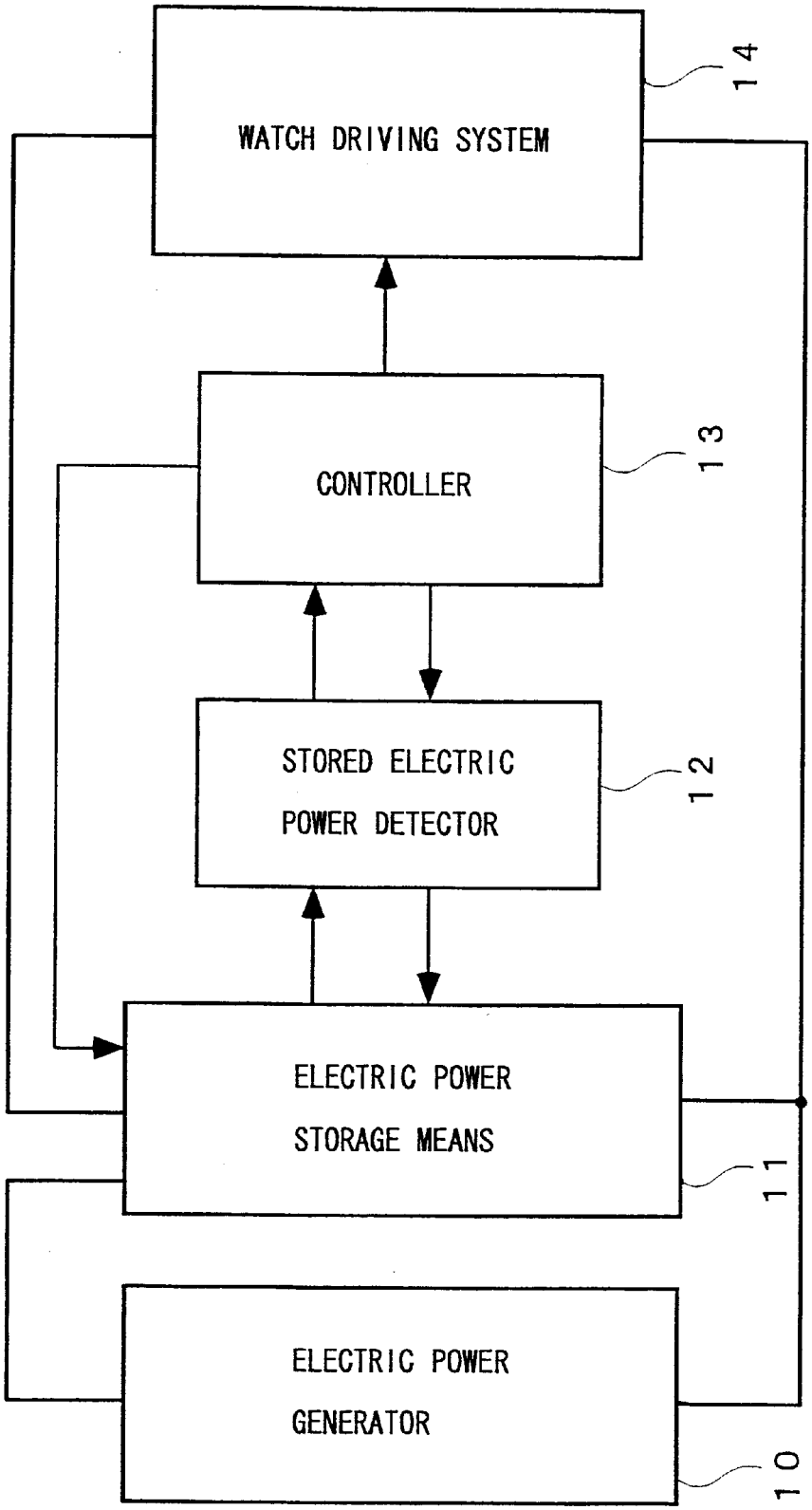
FIG. 1 is a block diagram showing the general arrangement of a first embodiment of an electronic watch according to the invention.

FIG. 1 is a block diagram showing the general arrangement of a first embodiment, that is, the basic embodiment of an electronic watch according to the invention.

In the electronic watch shown in FIG. 1, an electric power generator 10 by converting external energy into electric energy such as a solar cell or the like is connected with electric power storage means 11 for storing part or most of the electric energy converted, constituting a closed circuit.

The electric power generator 10 and the electric power storage means 11 for storing the electric energy are connected in parallel with a watch driving system 14 having functions associated with the driving of a watch, such as measurement of time, display of time, and the like.

In the case of an analog electronic watch, the watch driving system 14 comprises a crystal oscillator for generating a standard clock signal by use of a crystal resonator, a frequency divider circuit for forming signals at an appropriate timing (for example, at an interval of one second) by dividing the frequency of the standard clock signal generated by the crystal oscillator, a motor driving circuit for supplying a step motor with driving power according to the signals, the step motor, gears for transmitting rotation of the step motor while reducing a speed thereof, pointers, a dial, or the like. Meanwhile, in the case of a digital electronic watch, a time measurement counter and a liquid crystal driving circuit are used in place of the motor driving circuit, and a liquid crystal display for displaying time is used in place of the step motor, gears, pointers, dial, and the like.

Further, as shown in FIG. 1, electric energy for driving the watch driving system 14 is supplied by either the electric power generator 10, or the electric power storage means 11, or both. In respect of driving a watch only, the electronic watch is similar to an electronic watch driven by a primary battery having no means for generation of power.

In the case of a primary battery, however, a linear decrease with time occurs in the amount of electric energy stored therein while in the case of the electronic watch according to the embodiment of the invention, either of an increase or a decrease can occur to the amount of electric energy stored in the electric power storage means 11. Accordingly, even in case that conditions of the watch usage change variously, the watch can be driven stably by detecting the amount of electric energy stored in the electric power storage means 11, and feeding back the results of such detection to the watch driving system 14.

The electronic watch according to the first embodiment of the invention shown in FIG. 1 is therefore provided with stored electric power detector 12 for detecting the amount of electric energy (amount of electric power) stored in the electric power storage means 11, and with a controller 13 for controlling the stored electric power detector 12, controlling the electric power storage means 11 based on the results of the detection by the stored electric power detector 12, and controlling the watch driving system 14 described hereinafter.

The controller 13 separates at a predetermined cycle the electric power storage means 11 from the electric power generator 10 and the watch driving system 14, for a short time, measures the amount of electric energy stored in the electric power storage means 11 by the stored electric power detector 12, and determines whether the amount of electric energy stored as measured is at not more than a predetermined standard value or not. In the meantime, the watch driving system 14 is driven continuously by electric energy stored in a small capacitor incorporated therein.

When the controller 13 determines that the amount of electric energy stored in the electric power storage means 11 is at not more than a standard value, the watch driving system 14 is caused to stop driving the watch, preventing depletion of electric energy stored in the electric power storage means 11.

To stop driving the watch in this instance means that operation of at least the time display system of the watch driving system 14 is caused to stop. That is, in the case of the analog electronic watch, supply of power to the driving circuit of the step motor for moving the hands is stopped, and in the case of the digital electronic watch, either supply of power to a liquid crystal display is stopped, or the liquid crystal display is turned to a power-down mode such as a sleep mode or the like, while the crystal oscillator and the frequency divider circuit are preferably in operation.

Even in the case of leaving the electronic watch with the time display system of the watch driving system 14 out of operation, and without supply of external energy to the electric power generator 10, electric energy remaining in the electric power storage means 11 can be maintained for a long time as electric power consumed in the crystal oscillator and the frequency divider circuit of the watch driving system 14 is minimal.

The duration for maintaining electric energy remaining in the electric power storage means 11 can be further considerably prolonged by stopping all operations of the watch driving system 14. However, in such a case, it becomes necessary for a user to reset the watch to the correct time by hand when reactivating the watch driving system 14.

When the controller 13 detects conditions for reactivation of operation, part of the watch driving system 14, of which operation was suspended, is reactivated, and the reactivated operation is continued for at least a predetermined period.

In the case of the analog electronic watch, the time when manipulation of a winding crown to reset the watch to the correct time is detected may be defined as a time when the conditions for reactivation of operation are detected. Otherwise, the time when detection is made of the watch case being touched by the hand of a user, or of start of generation of power by the electric power generator 10 (electric energy above a predetermined level) may be defined as such.

Then, control is performed such that a standard value, with which the amount of electric energy detected by the stored electric power detector 12 is compared, is lowered by one rank from the standard value at which operation was previously stopped.

Consequently, all operations of the watch driving system 14 can be continued until the amount of electric energy stored declines below the standard value lowered by one rank, ensuring stable driving of the watch after reactivation.

If sufficient electric energy is generated by the electric power generator 10 in the meantime, the amount of electric power stored in the electric power storage means 11 is increased enabling the watch driving system 14 to continue stable operation for a longer period.

Further, when the amount of electric power stored in the electric power storage means 11 is increased sufficiently in excess of the standard value lowered by one rank, a remaining amount of electric power stored at the next time of stopping display of time can be increased by raising the standard value by one rank.

After restarting operation of the portion of the watch driving system 14, wherein operation is suspended, the operation may be continued for at least a preset given period.

Even then, in the case where the electronic watch provided with the electric power generator incorporated therein is put to use again after being left unused for a relatively long interval, stable starting operation of displaying time (by movement of the hands or digital liquid crystal display) can be effected without immediate stop of the watch, and then the watch is driven stably even if usage conditions change variously.

In the case of the digital electronic watch, provided that the crystal oscillator, the frequency divider circuit, and the time measurement counter are kept in operation during a period when display of time by the liquid crystal display is suspended by the watch driving system 14, an accurate time can be displayed on the liquid crystal display immediately upon resumption of operation of displaying time.

Second Embodiment

Now, a second embodiment of an electronic watch according to the invention will be described hereinafter with reference to FIGS. 2 to 4.

Figure 2:
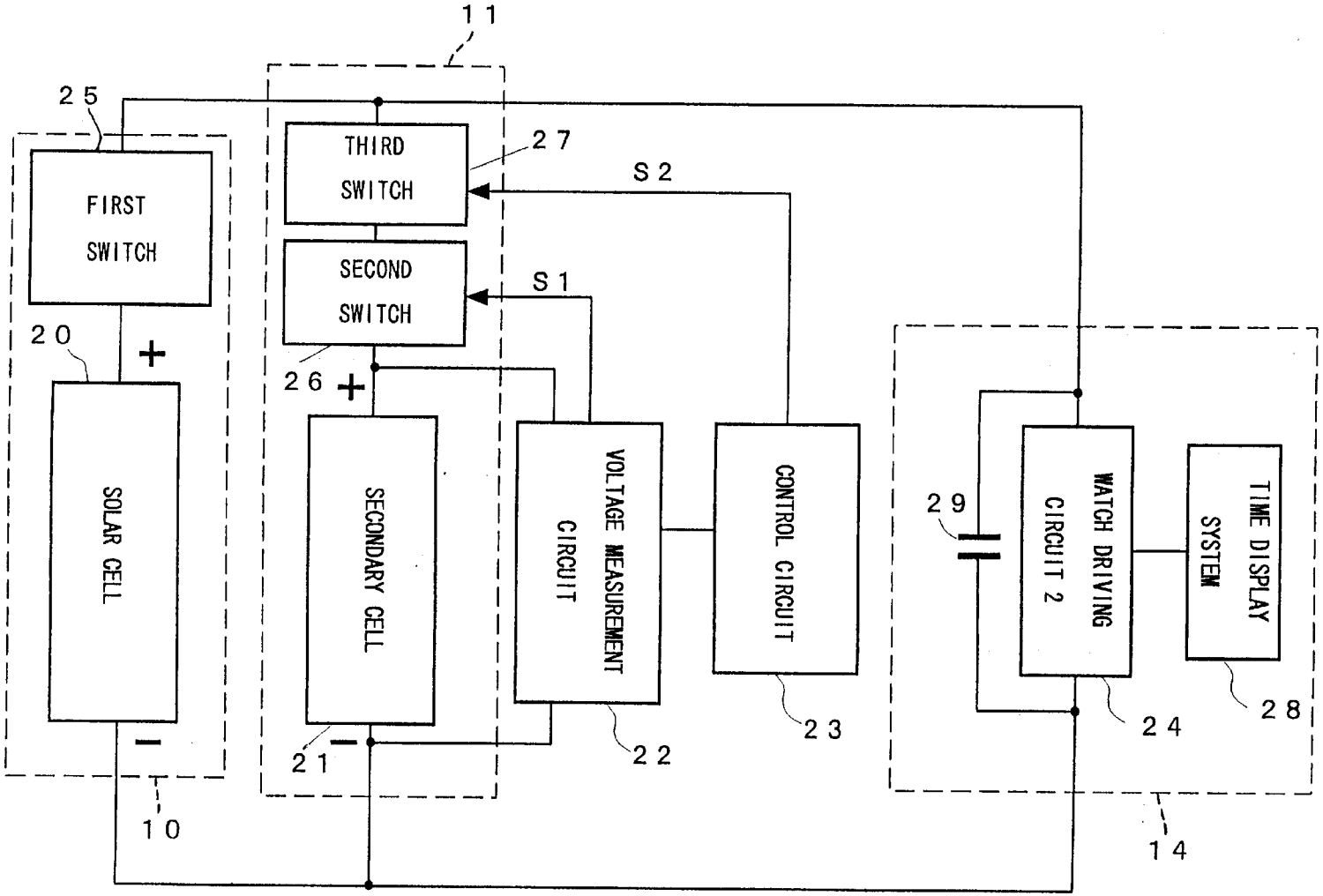
FIG. 2 is a block diagram showing the general arrangement of a second embodiment of an electronic watch according to the invention.

FIG. 2 is a block diagram showing the general arrangement of the electronic watch. In the electronic watch, a solar cell 20 and a first switch 25, corresponding to the electric power generator 10 shown in FIG. 1, are connected with a secondary cell 21, a second switch 26 and a third switch 27, corresponding to the electric power storage means 11 shown in FIG. 1, constituting a closed circuit.

The electric power generator 10 and electric power storage means 11 are connected in parallel to a watch driving system 14, which is driven by a voltage supplied by either of the solar cell 20 and the secondary cell 21.

The watch driving system 14 comprises a watch driving circuit 24, a time display system 28, and a capacitor 29.

The watch driving circuit 24 further comprises a crystal oscillator for generating a standard clock signal, a frequency divider circuit for forming signals at an appropriate timing (for example, at a period of one second) by dividing the frequency of the standard clock signal, and in the case of an analog electronic watch, a motor driving circuit for supplying a step motor with driving power according to the signals. The time display system 28 functions as a section for causing the watch to display time, and comprises, in the case of an analog electronic watch, a step motor, gears for transmitting rotation of the step motor while reducing a speed thereof, pointers, a dial, and the like.

In the case of a digital electronic watch, a time measurement counter and a liquid crystal driving circuit are used in place of the motor driving circuit of the watch driving circuit 24, and also a liquid crystal display for displaying time is used in place of the step motor, gears, pointers, dial, and the like of the time display system 28.

The capacitor 29 is provided to ensure normal operation of the watch driving circuit 24 and the time display system 28 by utilizing electric energy stored therein even during brief and temporary suspensions of supply of electric energy from the solar cell 20 and the secondary cell 21.

In the second embodiment of the invention, a voltage measurement circuit 22 and a control circuit 23, corresponding respectively to the stored electric power detector 12 and the controller 13 of the electronic watch according to the first embodiment shown in FIG. 1 are provided.

For the secondary cell 21 of the power storage means 11, for example, a lithium-ion secondary battery is used. In the case of using a manganese-titanium-based lithium-ion battery of 1.5V for the lithium-ion secondary battery, discharge characteristics showing the relationship between output voltages and discharge amounts thereof demonstrate a stable gradient at output voltages in the range of about 1.2 to 1.4V as shown in FIG. 4.

In a diagram shown in FIG. 4, arbitrary units are used for both the vertical axis and horizontal axis for generalization, and points corresponding to output voltages V(1) to V(4), and discharge amounts D(1) to (D4) are indicated for explanation given hereinafter.

The first switch 25 described above is provided to prevent reverse flow of electric current from the secondary cell 21 to the solar cell 20 when the solar cell 20 stops delivering power when photo irradiation is not received from external sources.

Accordingly, a diode having a rectifying switching characteristic is used for the first switch 25. The diode is connected such that forward current flow occurs when the secondary cell 21 is charged by the solar cell 20 (in this case, the anode of the diode is connected to the positive electrode side of the solar cell 20, and the cathode thereof to the positive electrode side of the secondary cell 21).

The second switch 26 is turned on or off responding to a control signal S1 from the voltage measurement circuit 22, while the third switch 27 is turned on or off responding to a control signal S2 from the control circuit 23.

Accordingly, for the second switch 26 and the third switch 27, an MOS (metal oxide semiconductor) type field-effect transistor (hereinafter referred to as MOST) having switching characteristics of being turned on or off responding to the control signals S1 and S2, is used, respectively.

Connection of the MOSTs serving as the second switch 26, and the third switch 27, respectively, is made on the positive electrode side of the secondary cell 21 such that respective sources and drains are connected in series, and the control signals S1 or S2 are applied to respective gates.

As a result of connection as described above, a closed circuit is formed by the solar cell 20, the first, second, and third switches 25, 26, and 27, and the secondary cell 21. Electric energy is stored in the secondary cell 21 through the closed circuit when the solar cell 20 subjected to external photo energy is in a state of generating electric power provided that the second and third switches 26 and 27 are kept in the on condition at all times by the control signals S1 and S2. The first switch 25, which is biased in the forward direction in this instance, is automatically turned on.

Then, the voltage measurement circuit 22 turns the second switch 26 off for a short time by the control signal Si under a command from the control circuit 23, and detects the state of electric power stored in the secondary cell 21 by measuring the voltage between terminals thereof. The state of electric power stored in the secondary cell 21 is thus detected by measuring the voltage between the terminals thereof because as shown in FIG. 4, the relationship between the discharge amounts and the outputs is linear at the output terminals of the secondary cell 21 in the range of 1.2 to 1.4V wherein the watch can be driven.

Figure 4:
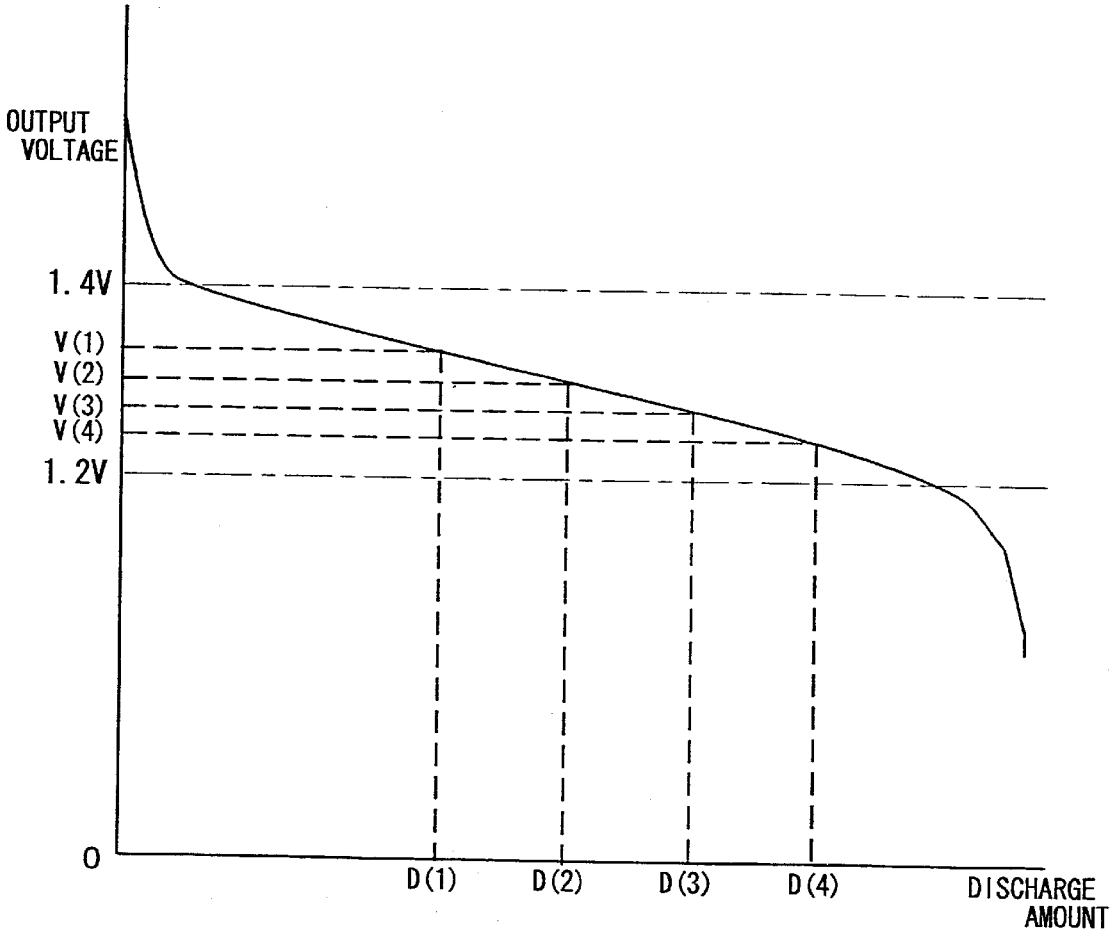
FIG. 4 is a diagram showing discharge characteristics of a lithium ion cell.

That is, as shown in FIG. 4, the output voltage varies in proportion to variation in the discharge amount at the output terminals in the range of 1.2 to 1.4V, and consequently, the amount of discharge of the secondary cell 21 can be found by measuring the output voltage thereof. As the amount of electric energy stored is the maximum amount of electric energy able to be stored less the discharge amount, the amount of electric energy stored can be detected by measuring the output voltage.

In the second embodiment, a standard value V(n) of the output voltage described in detail hereinafter (standard value on the basis of which is determined whether at least the time display system 28 of the watch driving system 14 is stopped or not) is set within the range from 1.2 to 1.4V where the output voltage is stable. In this context, n is an integer indicating a number for the respective standard values, and in the embodiment shown in FIG. 4 by way of example, can be any number from 1 to 4.

Any number of standard values can be set if same are within a detectable range. However, in this embodiment, any among four standard values V (1) to V (4) set at intervals of 0.03V in the range of 1.25 to 1.34V may be selected and set as shown in FIG. 4. Discharge amounts corresponding to the standard values V (1) to V (4), respectively, are D (1) to D (4) due to the discharge characteristic. The relationship among the magnitudes of the standard values V (1) to V (4) is as follows:

$$V(4)<V(3)<V(2)<V(1)$$

When measuring the output voltage of the secondary cell 21 by the voltage measurement circuit 22, the secondary cell 21 is electrically separated from the closed circuit formed when same is charged with electric energy, by turning the second switch 26 off by the control signal S1.

The control circuit 23 keeping the third switch 27 in the on condition all the time by the control signal S2 compares an output voltage of the secondary cell 21 as measured by the voltage measurement circuit 22 with a preset standard value V (n) (initially, the standard value is set at the highest level, that is, V (1)), and when the output voltage of the secondary cell 21 as measured is found to be lower than the standard value V (n), causes the third switch 27 to be turned off by the control signal S2, stopping supply of electric power from the second battery 21 to the watch driving system 14.

Consequently, if the solar cell 20 is not generating electric power at this point in time, supply of electric power to the watch driving system 14 stops, and when electric energy stored in the capacitor 29 is used up, operation of the watch driving circuit 24 and the time display system 28 come to a stop.

Accordingly, even if the electronic watch in this condition is left unused for a long time, the amount of electric energy stored in the secondary cell 21 is kept at a level slightly below the standard value V (n).

Thereafter, when conditions for reactivation come to pass, for example, an action to reactivate the watch such as resetting the watch to a proper time of day typically by adjusting the hands thereof is performed, the control circuit 23 turns the third switch 27 on (the second switch 26 being in the on condition all the time), causing operation of the watch driving system 14 to be resumed.

More specifically, a mechanical action such as pulling out a winding crown is made for adjusting the hands, which the control circuit 23 senses, and it outputs the control signal S2 for turning the third switch 27 on.

At this time, the control circuit 23 changes the preset standard value V (n) to a standard value lower by one rank (the number n is increased by one). For example, in the case where the standard value V (n) is set at V (1) as shown in FIG. 4, same is changed to V (2). As a result, even if the solar cell 20 remains in a condition of not generating electric power, the watch driving system 14 can continue operation until at least the output voltage of the secondary cell 21 as measured by the voltage measurement circuit 22, is found to be lower than the standard value changed to a lower level by one rank, thus stabilizing operation of displaying time after reactivation.

The controlling operation by the control circuit 23 will be described in detail hereinafter with reference to the flow chart in FIG. 3.

In Step 30, immediately upon the start of the controlling operation by the control circuit 23, the control circuit 23 turns the second switch 26 on by the control signal S1 from the voltage measurement circuit 22, and sets the integer n to zero, putting the watch in an initial condition.

Starting from the initial condition, in subsequent Step 31, the control circuit 23 turns the third switch 27 off by the control signal S2 therefrom.

By this, the watch driving system 14 comprising the watch driving circuit 24 and the time display system 28 is put out of operation unless the solar cell 20 delivers an output voltage.

Subsequently, in Step 32, whether an action of adjusting the hands of the watch is made or not is determined, and if so, the control operation proceeds to Step 33 while the deactivated condition continues.

In Step 33, one is added to the n (n=n+1), setting the standard value V (n) on that basis. Initially, n=0. Hence, n+1=1. Accordingly, the standard value V (n) is set at the highest voltage level V (1) shown in FIG. 4.

Then, in Step 34, the third switch 27 is turned on.

Before turning the third switch 27 on, it is important to apply the operation to increase the integer n by one for changing (resetting) the standard value of the output voltage at which operation of the watch driving system 14 is to be stopped next time.

The larger the value of the integer n, the lower the voltage level to which the standard value becomes. A voltage level at the standard value V (1) when n=1 is the highest, while a voltage level at the standard value V (n max.) is the lowest. In the case of the example shown in FIG. 4, n max.=4. Consequently, as n is increased by one every time that operation goes through Step 33, the standard value is changed to one lower by one rank than the previous standard value.

In Step 34 wherein the second switch 26 is already in the on condition, as soon as the third switch 27 is turned on, electric energy is supplied from the secondary cell 21 to the watch driving system 14, enabling continuous driving of the watch. That is, the watch is in normal operating condition.

Once the watch is in normal operating condition, the control signal S1 is outputted from the voltage measurement circuit 22 at predetermined intervals (Step 35), turning the second switch 26 off. After electrically separating the secondary cell 21 from the closed circuit, the output voltage V of the secondary cell 21 is measured by the voltage measurement circuit 22 in Step 36.

Immediately after measuring the output voltage V, the second switch 26 is turned on again by the control signal S1 in Step 37. During a period when the second switch 26 is in the off condition, operation of the watch driving system is continued by electric energy stored in the capacitor 29 shown in FIG. 2.

Subsequently in Step 38, discrimination of measured values of the output voltage V of the secondary cell 21 is performed. Results of the discrimination are broken down into three cases according to measured values of the output voltage V.

In a first case, $V(n) \leqq V \leqq V(n)+\alpha$. In this case, $\alpha$ is a voltage value representing a differential, substantially larger than a difference between V (n−1) and V (n), and smaller than a difference between V (n−2) and V (n). That is, $\alpha$ is larger than a difference between the present standard value and a standard value lower than that by one level, but smaller than a difference between the present standard value and a standard value lower than that by two levels. In the example shown in FIG. 4, a difference by one level is 0.03V.

The values of a series of voltages V (n), however, need not be set at a substantially equal differential in voltage, and may be set such that a differential in the discharge amount diminishes or increases in the order of D (1), D (2), D (3) . . . D (n max.) by diminishing or increasing the differential in the voltage in the order of V (1), V (2), V (3), . . . V (n max.).

Further, V (1) may preferably be set at a voltage corresponding to a discharge amount equivalent to or not less than a fraction of the maximum power storage capacity of the secondary cell 21. If V (1) is set so as to correspond to a too small discharge amount, operation is prone to turning to a stop mode quickly in the initial period of driving the watch.

Reviewing conditions of the first case described above, it can be said that the power storage condition of the secondary cell 21 is relatively good since the discharge amount has not reached D (n) as yet. This means that the controlling operation is in a state of ensuring stable driving of the watch even without supply of power from the solar cell 20 for the time being. Thereafter, the operation waits for the elapse of a predetermined length of time in Step 39, and then, proceeds again to Step 35, measuring the output voltage of the secondary cell 21 in Step 36, and repeating the discrimination of the measured values of the output voltage of the secondary cell 21 in Step 38.

In a second case: $V>V(n)+\alpha$. This indicates that the amount of power generated by the solar cell 20 has been substantial, and the power storage condition of the secondary cell 21 is much better than in the first case.

In this case, the operation proceeds to Step 40, wherein values of n are discriminated, and then proceeds to Step 41 if $n>1$, subtracting one from the integer n ($n=n-1$), and after the elapse of a predetermined length of time, reverts to step 35, then the output voltage of the secondary cell 21 is measured, and the operation proceeds to the step of discriminating measured values of V. In Step 40, if $n=1$, the operation of subtracting one is omitted since n at minimum is 1.

Hereupon, even if the solar cell 20 stops generating power immediately after subtracting 1 from n, driving of the watch does not come to a stop quickly as $\alpha$ is a voltage value representing a differential, substantially larger than a difference between $V(n-1)$ and $V(n)$, and smaller than a difference between $V(n-2)$ and $V(n)$ as described hereinbefore.

In a third case, $V<V(n)$. This indicates that the amount of power generated by the solar cell 20 has been very small, and the power storage condition of the secondary cell 21 has deteriorated from its condition in the first case.

In such a case, the operation discriminates values of n in Step 42, and if $n<n$ max., reverts to Step 31, outputting the control signal S2 for turning the third switch 27 off from the control circuit 23. As a result, supply of power from the secondary cell 21 to the watch driving system 14 is terminated. Accordingly, the watch driving circuit 24 and the time display system 28 of the watch driving system 14 are deactivated unless power is supplied by the solar cell 20.

Thus, further deterioration of the power storage condition of the secondary cell 21 is prevented.

If $n=n$ max. in Step 42, the operation waits for a predetermined length of time in Step 43, and proceeds to Steps 35, and 36, measuring the output voltage V of the secondary cell 21 again. In case that the solar cell 20 has started generating power in the meantime, electric energy generated thereby is stored in the secondary cell 21, and through discrimination of values of V in Step 38, a case of $V<V(n)$ can occur.

In this embodiment, discrimination of values of the integer n is made in Step 42, and if $n=n$ max., the third switch 27 is not turned off exceptionally so as not to suspend driving the watch. This is because firstly when the amount of power stored in the secondary cell 21 is almost nil, it is of little significance to prevent further deterioration of the power storage condition thereof, and secondly, in case of the solar cell 20 starting generation of power later, there is a possibility of improving the power storage condition by storing electric energy generated thereby in the secondary cell 21. Without adoption of such an exceptional step as above, however, if $V<V(n)$ as a result of the discrimination in Step 38, the operation may proceed to Step 31 omitting Step 42 for discrimination of values of n, turning the third switch 27 off.

Figure 3:
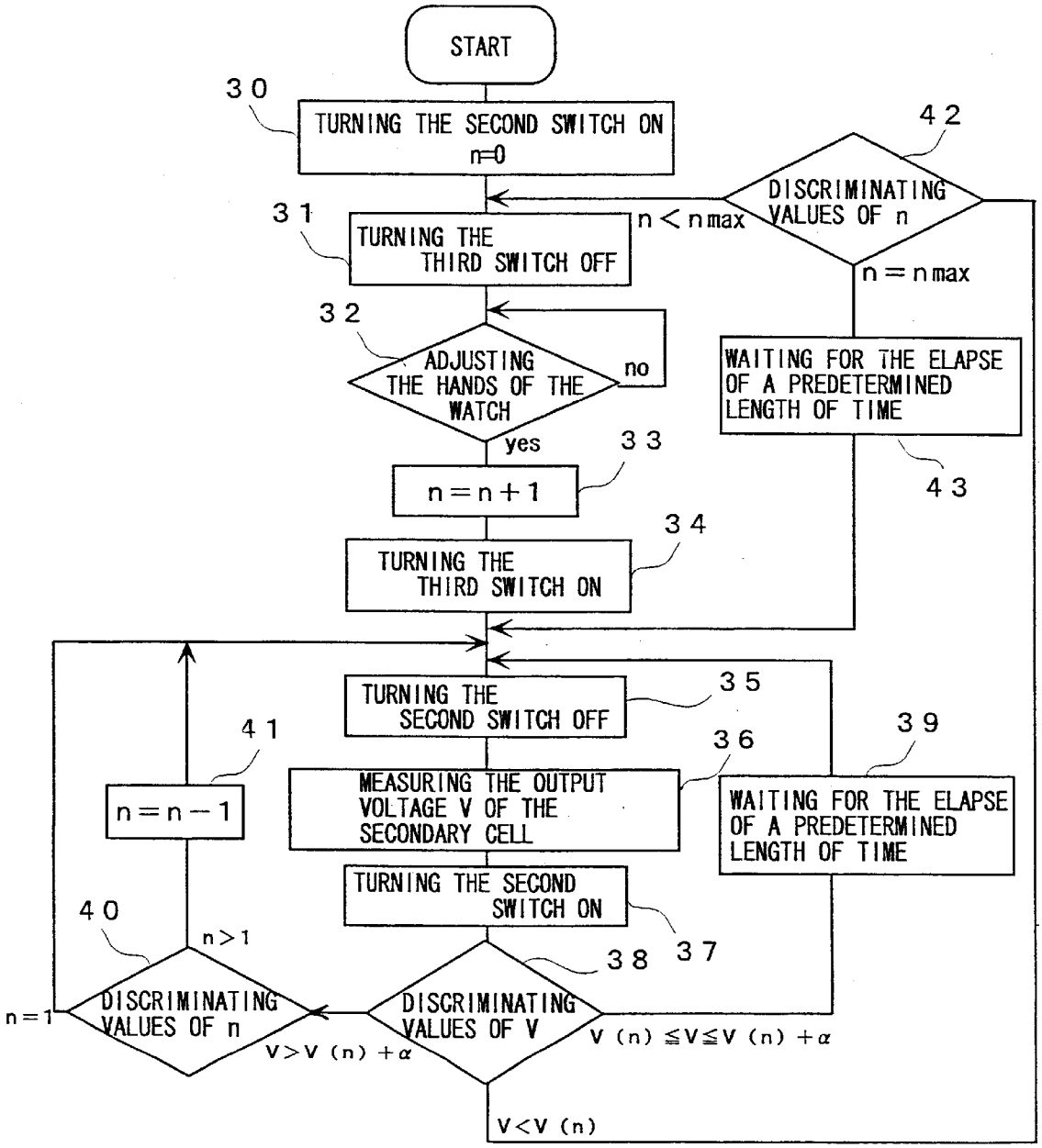
FIG. 3 is a flow chart showing operation of a control circuit in the electronic watch shown in FIG. 2.

Of particular importance in the second embodiment is the third case of discrimination shown in the flow chart in FIG. 3. In this case, further deterioration of the power storage condition of the secondary cell 21 is prevented by suspending operation of the watch driving system, and an effect thereof is demonstrated in a pronounced way when the watch is reactivated.

That is, reactivation occurs by an action such as adjustment of the hands of the watch, or the like, and simultaneously, an operation of increasing the value of the integer n by one as described in the foregoing. Consequently, when values of the output voltage V of the secondary cell 21 are discriminated after reactivation in accordance with the flow chart shown in FIG. 3, the standard value for discrimination is made lower than the preset V(n) by one level to a new standard value $V(n+1)$. This enables the watch driving system 14 to continue operation until the discharge amount from the secondary cell 21 reaches $D(n+1)$ at least even without supply of external energy.

That is, lowering by stages of the standard value of the output voltage, based on which decision is made on whether operation of the watch driving system 14 is to be suspended or not, ensures stable driving of the watch for a long time by preventing display of time from coming to a stop quickly even in case that sufficient power has not been stored immediately after reactivation.

Such controlling operation as described above is particularly beneficial to a solar cell watch, and the equivalent, which are prone to difficulty in securing a sufficient amount of power generation after activation due to, for example, little ambient light being radiated onto the watch if it happens to be hidden under the sleeves of a user, or a watch wherein an amount of power generation at a high level is difficult to obtain while storing power in a short time is difficult to achieve. An example of the latter case is a thermocouple power generation watch for converting the difference between body temperature and an ambient temperature into electric energy by use of a thermocouple.

In this embodiment, when the output voltage of the secondary cell 21 as measured by the voltage measurement circuit 22 is found to be lower than the preset standard value, the control circuit 23 turns the third switch 27 off, suspending operation of the watch driving system 14 completely.

Instead, by controlling directly the watch driving system 14 with the use of the control circuit 23 as in the case of the first embodiment described in the foregoing, operation of only the time display sub-system 28 and the motor driving circuit or the liquid display driving circuit of the watch driving circuit 24 may be suspended, keeping the crystal oscillator, the frequency dividing circuit, the time measurement counter, and the like in operation. By doing so, setting the time display sub-system 28 to a proper time of day may be made automatically when resuming driving of the watch.

Further, in FIG. 2, the second switch 26 and the third switch 27 with functions divided therebetween are provided in the electric power storage means 11 in order to simplify explanation. However, these may be integrated into one switch for performing control operations upon receipt of the control signals S1 and S2.

For the electric power generator 10, an electromagnetic generator using a rotary weight, a thermoelectric generator, and the like, other than the solar cell 20, may be employed.

Further, for the means for electric power storage means 11, a large capacity capacitor, or the equivalent, other than the secondary cell 21, may be employed.

For the stored electric power detector, a current integrating circuit other than the voltage measurement circuit 22 may be employed.

In measuring the amount of electric power stored in the electric power storage means 11, the output voltage of the electric power storage means 11 is employed for measurement. However, this may not be limited thereto. Furthermore, the same effect can be attained by finding a rate of variation in voltage of the electric power storage means 11 in place of the amount of electric power stored therein.

Third Embodiment

A third embodiment of an electronic watch according to the invention will be described hereinafter with reference to FIGS. 5 to 8.

Figure 5:
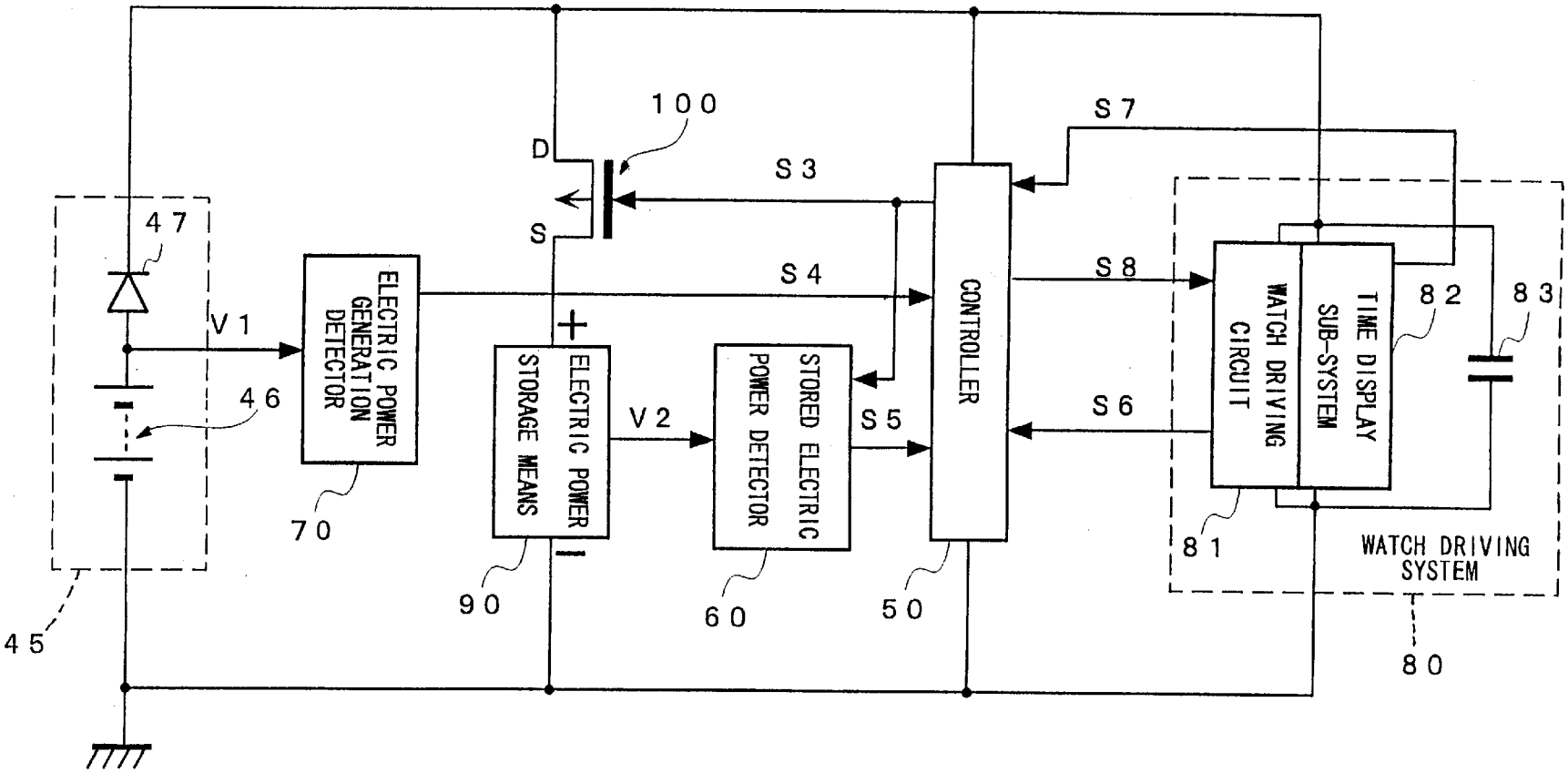
FIG. 5 is a block diagram showing the general arrangement of a third embodiment of an electronic watch according to the invention.

FIG. 5 is a block diagram showing the general arrangement of the third embodiment of the electronic watch according to the invention.

The electronic watch according to the third embodiment is provided with electric power generator 45 comprising a power generation device 46 for generating electric power by converting external energy into electric energy, and a diode 47 for preventing reverse flow of the electric energy generated, connected in series to the former.

For the power generation device 46, a thermoelectric power generation device for generating power by providing a difference in temperature at opposite ends of a plurality of integrated thermocouples, is employed. Although not shown in the figures, the power generation device 46 is constructed so as to cause a warm contact thereof to be in touch with the back cover of the electronic watch and a cold contact thereof to be in touch with the surface of the electronic watch such that a difference in temperature between both contacts occurs when a user carries the watch along, enabling electric power to be generated.

For the diode 47, a diode having a relatively small voltage drop such as a Schottky barrier diode is employed.

As shown in FIG. 5, a watch driving system 80 and controller 50 are connected in parallel to the electric power generator 45, and electric power storage means 90 is connected in parallel to the former via switching means 100. Accordingly, the watch driving system 80 and controller 50 can be operated by supply of either or both of electric energy generated by the electric power generator 45 and electric energy stored in the electric power storage means 90.

For the switching means 100, a p-channel MOS field effect transistor (hereinafter referred to merely as a FET) is employed, and the drain (D) of the FET is connected to the positive electrode (plus) terminal of the electric power generator 45. The switching means 100 may be installed in integrated circuits including the watch driving circuit 81 within the watch driving system 80.

Meanwhile, for the electric power storage means 90, a lithium ion secondary cell is employed, and the positive electrode of the electric power storage means 90 is connected to the source (S) of the switching means 100.

The controller 50 performs switching action of the switching means 100, that is, on/off control, by electrically disconnecting or connecting the electric power generator 45 from or to the electric power storage means 90. To this end, the controller 50 outputs a control signal S3 to the gate of the FET serving as the switching means 100, and stored electric power detector 60, respectively. The negative electrode of the electric power storage means 90 is connected to the negative electrode of the electric power generator 45, forming a closed circuit between the electric power storage means 90 and the electric power generator 45.

Further, an electric power generation detector 70 is an amplifier circuit for detecting the power generation condition of the electric power generator 45, to which a generated voltage V1 at the positive terminal of the power generation device 46 of the electric power generator 45 is inputted, and outputs a detection signal S4 for power generation to the controller 50.

The electric power generation detector 70 adopts a method of detecting power generation of the electric power generator 45 by checking whether the generated voltage V1 of the electric power generator 45 exceeds a given level or not. A value of the given level is set at, for example, 1.0 V, and the electric power generation detector 70 delivers the detection signal S4 at a high level in the case of the generated voltage V1 exceeding 1.0 V, and otherwise delivers the same at a low level.

The stored electric power detector 60 is an amplifier circuit for detecting a remaining amount of electric power stored in the electric power storage means 90 through the level of a voltage between the terminals thereof, to which a storage voltage V2, that is, the voltage between the terminals of the electric power storage means 90, is inputted, and outputs a detection signal S5 for indicating the remaining amount of stored power to the controller 50.

In this embodiment, the stored electric power detector 60 adopts a method of determining insufficiency in the remaining amount of electric power stored in the electric power storage means 90 by checking whether the storage voltage V2 exceeds a given level or not, in a manner similar to the case of the electric power generation detector 70 as described above. A value of the given level is set at, for example, 1.2 V, and the stored electric power detector 60 delivers the detection signal S5 for indicating the remaining amounts of stored power at a high level in the case of the storage voltage V2 of the electric power storage means 90 exceeding 1.2V, and otherwise delivers same at a low level, indicating insufficiency in the remaining amount of electric power stored in the electric power storage means 90.

Further, the controller 50 controls operation of the watch driving system 80 by the detection signals S4 and S5, delivered from the electric power generation detector 70 and the stored electric power detector 60, respectively.

The watch driving system 80 is provided with a watch driving circuit 81, a time display sub-system 82, and a capacitor 83 which are connected in parallel with each other.

The watch driving circuit 81 and the time display sub-system 82 correspond to the movement of an ordinary electronic watch.

In this case, for the time display sub-system 82, an analog type provided with hands for displaying time, a step motor for driving the hands, and the like, is employed.

For the capacitor 83, an electrolytic capacitor having a capacity, for example, on the order of 10 $\mu$F is employed.

The watch driving system 80 transmits a clock signal S6 outputted from the watch driving circuit 81, and a crown signal S7 outputted from the time display system 82 to the controller 50. The clock signal S6 and the crown signal S7 are described in detail hereinafter.

Further, the controller 50 transmits a control signal S8 for controlling operation of the watch driving system 80 to the watch driving circuit 81. The control signal S8 is also described in detail hereinafter.

Figure 6:
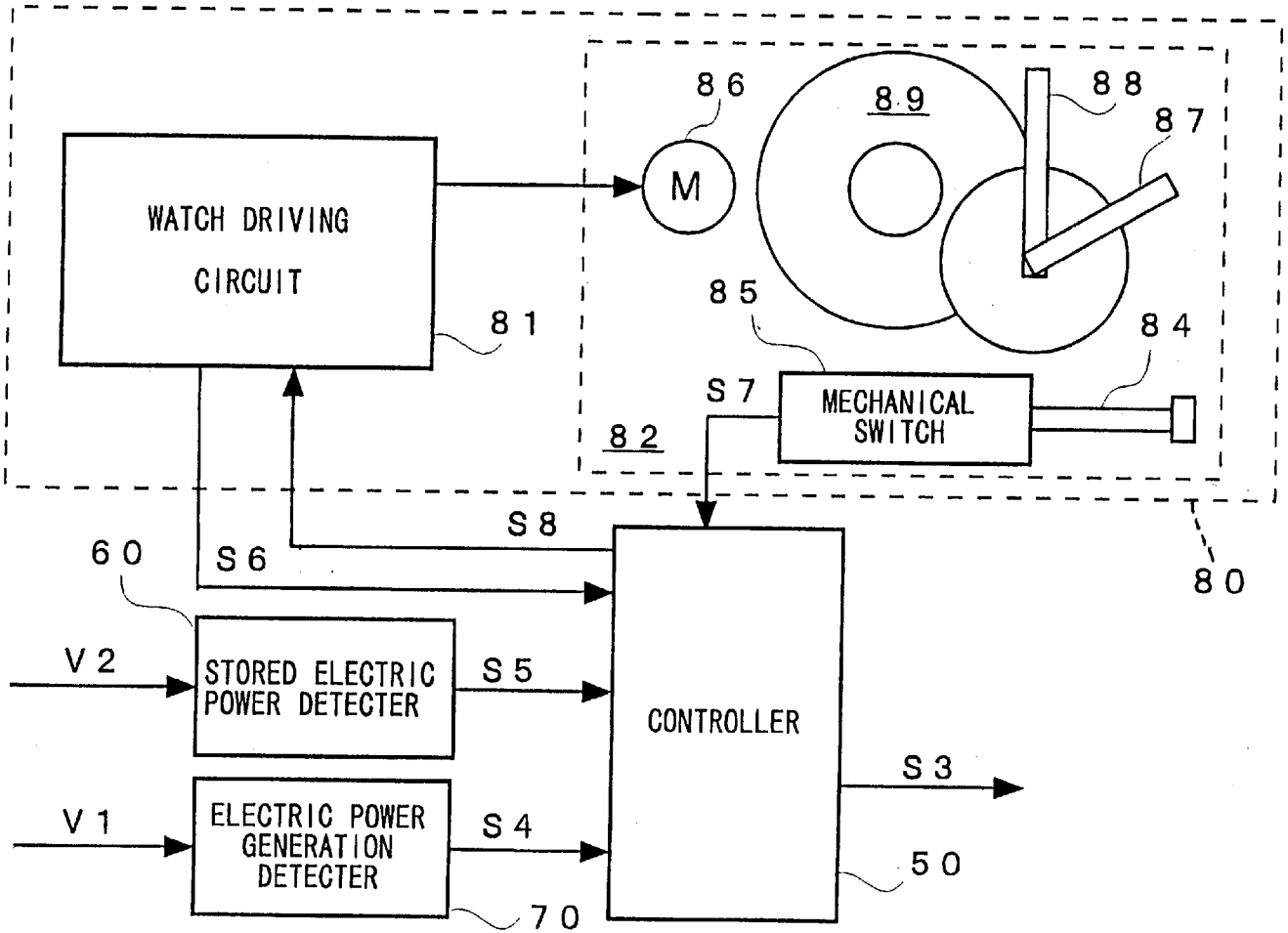
FIG. 6 is a block diagram showing part of the construction of the electronic watch shown in FIG. 5, involving a clock driving system 80, controller 50, a stored electric power detector 60, and an electric power generation detector 70.

FIG. 6 shows a specific example of the time display sub-system 82 of the watch driving system 80, and an arrangement involving the controller 50, the stored electric power detector 60, and the electric power generation detector 70.

The watch driving circuit 81 of the watch driving system 80 comprises a crystal oscillator, a frequency dividing circuit, a motor driving circuit, and the like, which are used in an ordinary electronic watch, and the frequency of a clock signal generated by the crystal oscillator is divided in the frequency dividing circuit until a cycle of at least 2 sec is attained, causing the motor driving circuit to generate a driving waveform for the step motor by a signal with frequency thereof divided as described.

As shown in FIG. 6, the time display sub-system 82 comprises the step motor 86 driven by steps according to the driving waveform generated in the motor driving circuit within the watch driving circuit 81, gears 89 for transmitting rotation of the step motor after reducing the r.p.m. thereof to pointers, the pointers consisting of a short hand 87 indicating hour and a long hand 88 indicating minute, rotatably reciprocated by the gears 89, a dial (not shown), and the like.

As with the case of an ordinary electronic watch, the watch driving circuit 81, the electric power generation detector 70, the stored electric power detector 60, and the controller 50 are composed of a complementary MOS transistor (CMOS) IC, respectively.

The watch driving circuit 81 inputs the signal S6 obtained by dividing the frequency of the clock signal generated by the crystal oscillator therein to the controller 50. The signal S6 is in a rectangular waveform at a cycle of, for example, 2 sec, and is used for controlling operation of the controller 50 such as on/off control of the switching means 100 as described hereinafter.

Also as with the construction of an ordinary electronic watch, the time display sub-system 82 is provided with a crown 84 and a mechanical switch 85 to allow a user to adjust the displayed time manually.

The short hand 87 and the long hand 88 of the time display sub-system 82 are rotated by pulling and turning the crown 84, enabling the time displayed to be set to a desired time of day.

The crown 84 is linked with a mechanical switch 85. The mechanical switch 85 is a mechanical contact for outputting a crown signal S7 at a high level when the crown 84 is in the state of being pushed in, and the same at a low level when the crown 84 is in the state of being pulled out.

The crown signal S7 is delivered to the controller 50, transmitting the condition of the crown 84 by a logic signal.

Further, a control signal S8 is transmitted from the controller 50 to the watch driving circuit 81. When the control signal S8 is at a high level, the watch driving circuit 81 activates the motor driving circuit, sending the driving waveform of the step motor 86 to the time display sub-system 82, and causing the step motor 86 to be driven to perform operation of displaying time.

When the control signal S8 is at a low level, however, the watch driving system 80 is arranged such that at least the motor driving circuit of the watch driving circuit 81 and the time display sub-system 82 are deactivated.

Figure 7:
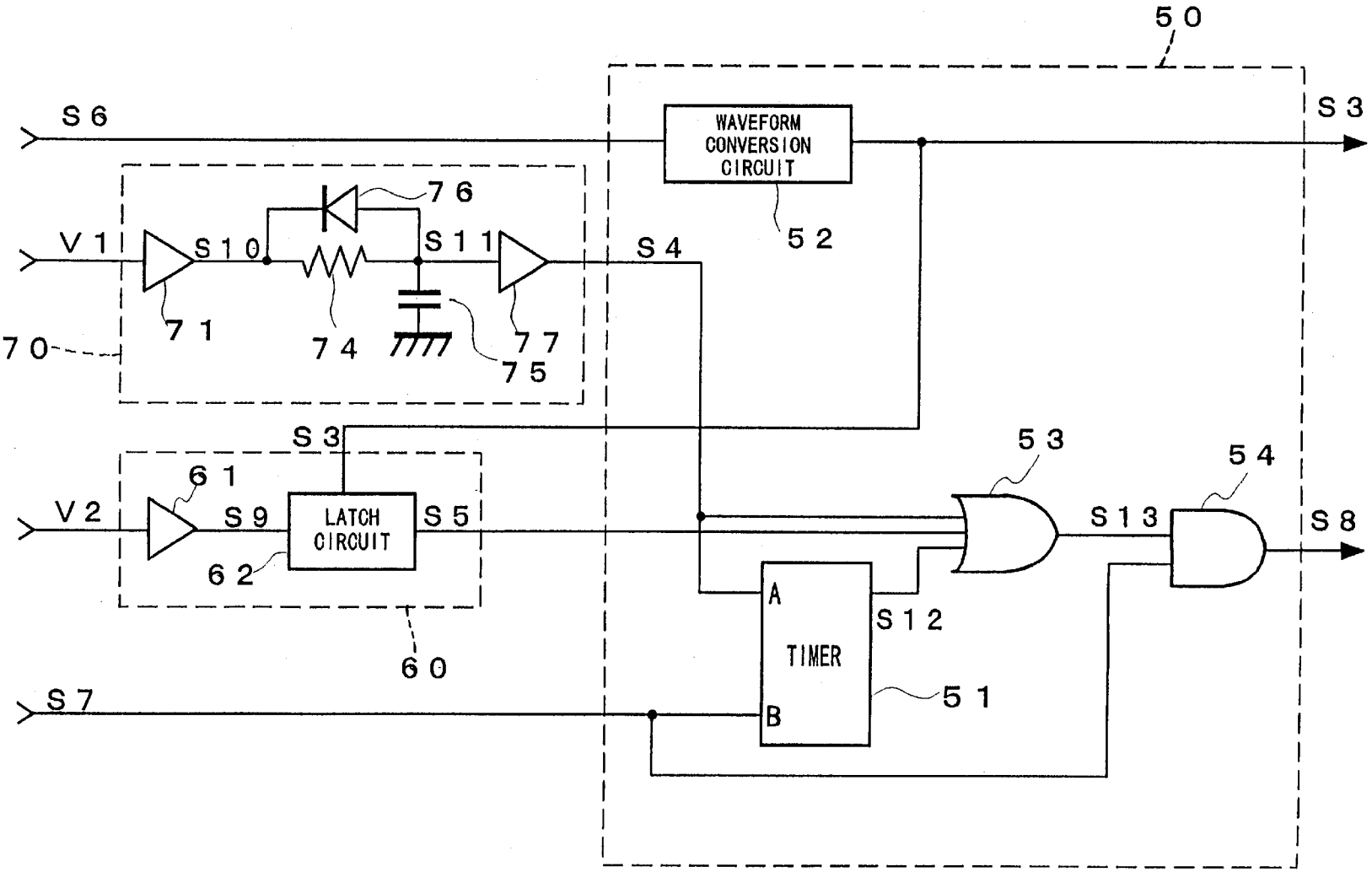
FIG. 7 is a circuit diagram of the electronic watch shown in FIG. 5, showing an example of specific circuits of the controller 50, the stored electric power detector 60, and the electric power generation detector 70.

Now a specific example of circuits for the stored electric power detector 60, the electric power generation detector 70, and the controller 50 of the electronic watch according to the third embodiment of the invention are shown in FIG. 7.

As shown in FIG. 7, the stored electric power detector 60 comprises an amplifier circuit 61 wherein the storage voltage V2 is inputted from the electric power storage means 90, and a threshold voltage is set such that an output signal S9 at a high level is delivered when the inputted voltage exceeds a preset standard value (for example, 1.2 V). Otherwise, an output signal S9 at a low level is delivered, and a latch circuit 62 for latching the output signal S9 at the falling edge of the control signal S3 inputted from the controller 50 is provided. The output signal thus latched is the detection signal S5 for detecting the remaining amount of electric power stored.

The electric power generation detector 70 comprises a power generation detection amplifier 71, a delay resistor 74, a delay capacitor 75, a discharge diode 76, and a detection output amplifier 77.

The delay resistor 74, delay capacitor 75, and discharge diode 76 are delay circuits for general use wherein rising of signal waveform is delayed.

The power generation detection amplifier 71 is the amplifier circuit described in the foregoing wherein the threshold voltage is set such that a signal at a high level is outputted in the case of the generated voltage V1 of the electric power generator 10 exceeding 1.0 V, and otherwise, a signal at a low level is outputted.

The rise time of an output signal S10 from the power generation detection amplifier 71 is delayed due to a time constant of the delay resistor 74 and delay capacitor 75. At a fall time of the output signal S10, electric charge accumulating in the delay capacitor 75 is discharged immediately through the discharge diode 76, and the signal falls.

When the level of a delay signal S11 in a waveform delayed by the rise time delay circuit exceeds 1.0 V, the detection output amplifier 77 outputs a signal at a high level, and otherwise, at a low level, as the power generation detection signal S4.

The delay resistor 74 and delay capacitor 75, constituting the delay circuit, are a so-called RC circuit, and on the basis of the time constant of the RC circuit, a delay time DT for effective detection of power generation is caused to occur.

Figure 8:
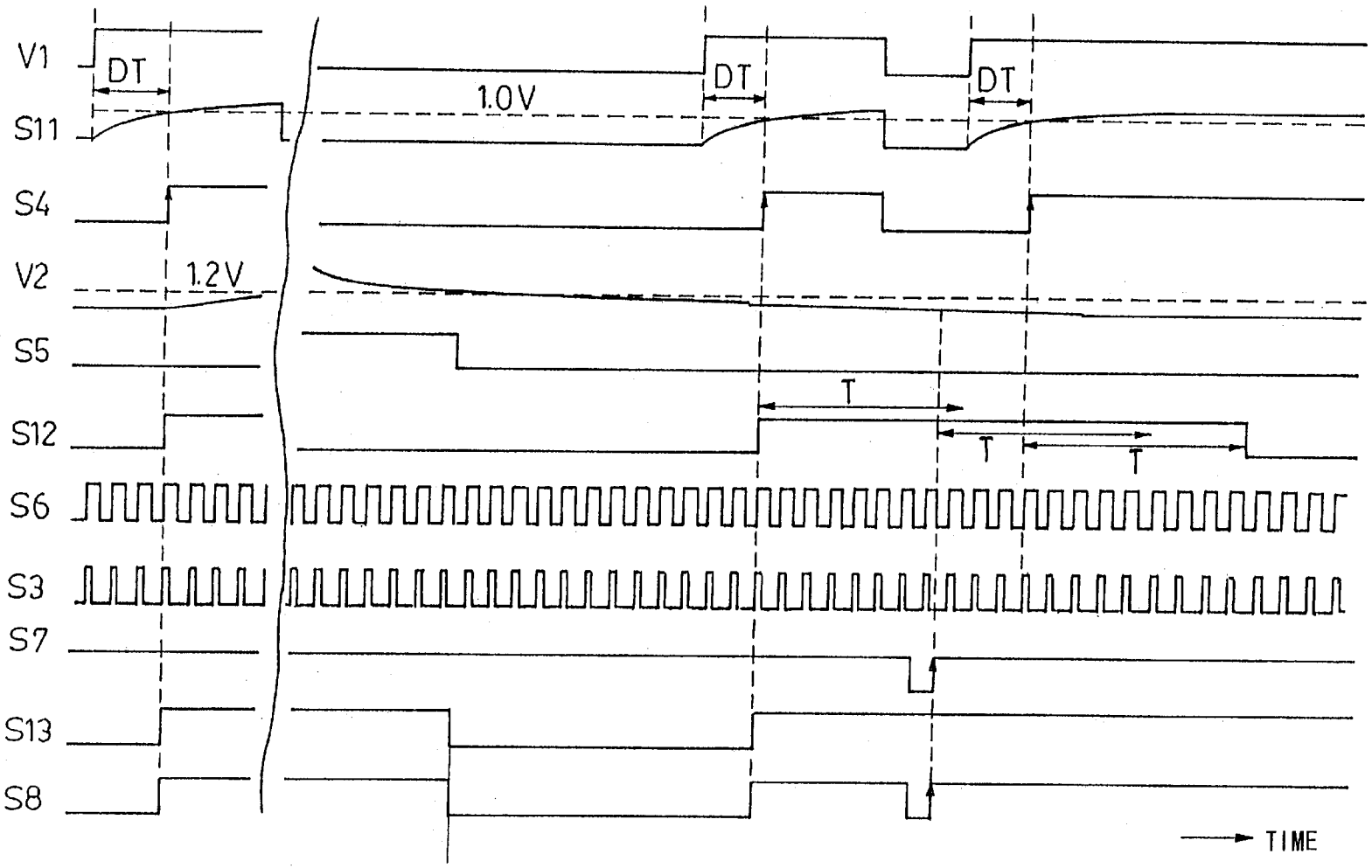
FIG. 8 is a timing diagram showing waveforms of respective signals in the circuits shown in FIGS. 5 to 7, and interrelationships therebetween.
Figure 9:
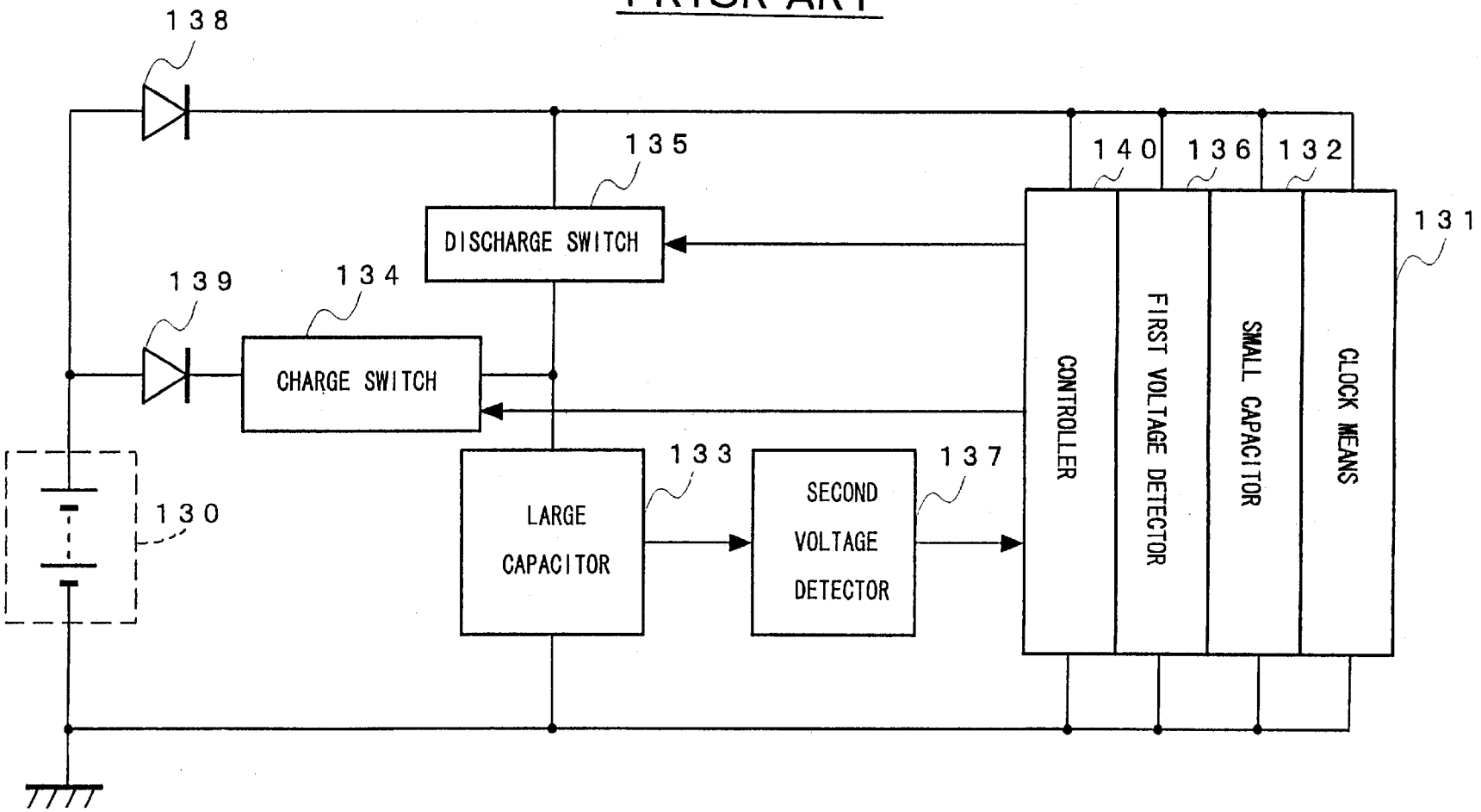
FIG. 9 PRIOR ART
FIG. 9 is a block diagram of an example of a conventional electronic watch with a built-in electric power generator.

The delay time DT is shown in a wave form chart in FIG. 8.

On the assumption of setting the delay time DT at 10 sec, the delay resistor 74 is about 10 MΩ provided that the delay capacitor 75 has a capacitance at 1 $\mu$F. However, a delay capacitor 75 having a large capacitance such as 1 $\mu$F, needs to be installed externally as it is difficult to form the same within the IC described.

The delay circuit is operated such that after the rise time of the waveform of the output signal S10 from the power generation detection amplifier 71, electric charge from the power generation detection amplifier 71 accumulates slowly in the delay capacitor 75 via the delay resistance 74, and after the elapse of the predetermined delay time DT, the terminal voltage on the ungrounded side of the delay capacitor 75 exceeds a threshold voltage of a logic circuit within the detection output amplifier 77, outputting the power generation detection signal S4 at a high level.

Conversely, at the fall time of the waveform of the output signal S10 from the power generation detection amplifier 71, electric charge built up in the delay capacitor 75 flows to the output terminal of the power generation detection amplifier 71 via the discharge diode 76, causing the terminal voltage on the ungrounded side of the delay capacitor 75 to come down instantly to a low level.

Thus, the electric power generation detector 70 operates such that when the waveform of the output signal S10 from the power generation detection amplifier 71 rises and is maintained at a high level for a period of effective power generation, rise of the waveform of the power generation detection signal S4 is delayed by the period of effective power generation against the output signal S10 from the power generation detection amplifier 71, and when the waveform of the output signal S10 falls the power generation detection signal S4 is caused to come down to a low level instantly.

By delaying the rise of the waveform of the output signal S10 from the power generation detection amplifier 71 as above, whether the signal level has become high suddenly due to noise or the like, or due to normal generation of power, can be determined. Accordingly, malfunction due to noise or the like can be prevented by providing the delay time DT for detection of effective generation of power by means of the delay circuit.

In case the internal resistance of the power generation device 46 is larger in comparison with the internal resistance of the electric power storage means 90, however, the electric power generation detector 70 is unable to detect the voltage of the generated power accurately. Hence, a latch circuit may be inserted on the output side of the detection output amplifier 77 so that the output signal from the detection output amplifier 77 is latched on the falling edge of the control signal S3, outputting the latched signal as the power generation detection signal S4.

The controller 50 comprises a timer 51, a waveform conversion circuit 52, an OR gate 53, and an AND gate 54.

The waveform conversion circuit 52 receives the signal S6 obtained by dividing the frequency of the clock signal from the watch driving circuit 81 shown in FIG. 6, and converts same into a pulse signal with a short pulse width, synchronized with the rising edge of the signal S6, which is then delivered to a latch circuit 62 of the stored electric power detector 60, and to the gate of a FET serving as the switching means 100 shown in FIG. 5 as the control signal S3 for detecting power storage condition.

For the waveform conversion circuit 52, a monostable multivibrator, for example, may be employed.

The timer 51 is provided with a timer start terminal A, to which the power generation detection signal S4 from the electric power generation detector 70 is inputted, and when the signal S4 rises from a low level to a high level, is reset, starting timer operation for a given time T.

The timer 51 is also provided with another timer start terminal B, to which the crown signal S7 is inputted, and is reset when the crown signal S7 rises from a low level to a high level (when the crown 84 shown in FIG. 6 is pushed in after being pulled out), starting timer operation for a given time T.

An output signal S12 from the timer 51 is normally at a low level including a time for activation of the IC comprising the timer 51, and remains at a high level only for a period of a given time T from start of timer operation (standard time: shown in FIG. 8) caused by the rise of the power generation detection signal S4, or the crown signal S7 as described above. For the timer 51, a retriggerable monostable multivibrator for two inputs, may be employed.

Accordingly, when the power generation detection signal S4, or the crown signal S7 rises again during timer operation of the timer 51, such timer operation is reset, starting a new timer operation for a period of given time T, and the output signal is maintained at a high level for a period of another given time T. In this embodiment, the given time T is set at, for example, 5 minutes.

The OR gate 53 receives the output signal S12 from the timer 51, the remaining amount detection signal S5 from the stored electric power detector 60, and the power generation detection signal S4 from the electric power generation detector 70, and outputs logical OR of these signals as an output signal S13. The AND gate 54 outputs logical AND of the output signal S13 from the OR gate 53 and the crown signal S7 as the control signal S8 to the watch driving circuit 81.

Now, referring to FIG. 8, operation of the electronic watch according to the third embodiment will be described hereinafter. FIG. 8 is a timing chart showing waveforms and mutual relationships of respective signals in the circuits shown in FIGS. 6 to 7.

Operation of the electronic watch when the electric power generator 45 starts generation of power is described hereinafter on the assumption that same is left unused for a long time, and the amount of electric power stored in the electric power storage means 90 is almost none.

Upon start of power generation by the electric power generator 45, electric energy accumulates first in the capacitor 83 in the watch driving system 80 shown in FIG. 5, initializing the watch driving system 80, controller 50, the electric power generation detector 70, and stored electric power detector 60, and operation for driving the watch is started.

When the condition of the generated voltage V1 delivered to the power generation detection amplifier 71 shown in FIG. 7 exceeds the given level, that is, 1.0 V as described before, for a period longer than the delay time DT due to the delay resistor 74 and delay capacitor 75, the electric power generation detector 70 causes the power generation detection signal S4 to rise from a low level to a high level.

Consequently, the OR gate 53 receiving the power generation detection signal S4 as one input causes the output signal 13 to rise to a high level regardless of the other inputs. Subsequently, the control signal S8 outputted from the AND gate 54 is caused to be at a high level since the crown signal S7 is at a high level if the crown 84 is in the state of being pushed in.

With the control signal S8 at a high level, the watch driving system 80 starts operation of all parts including the time display sub-system 82, initiating movement of pointers (the short hand 87 and the long hand 88) by driving the step motor 86 shown in FIG. 6.

At this moment, the clock signal is generated by the crystal oscillator contained in the watch driving circuit 81, and the pulse signal S6 at a given period obtained by dividing the frequency of the clock signal is inputted to the controller 50.

Then, the waveform conversion circuit 52 of the controller 50 shown in FIG. 7 outputs the control signal S3 having a short pulse width, synchronized with the rising edge of the pulse signal S6 to the gate of the FET, that is, the switching means 100, turning the switching means 100 off at a given cycle.

Accordingly, when the control signal S3 is at a low level, the switching means 100 is in the on condition, and electric energy generated by the electric power generator 45 is delivered to the electric power storage means 90 and is stored therein.

When the switching means 100 is in the off condition, the electric power storage means 90 is separated from the rest of the circuitry, and the output voltage V2 therefrom is detected by the stored electric power detector 60, wherein the output signal S9 from the amplifier circuit 61 shown in FIG. 7 is latched in the latch circuit 62 on the falling edge of the control signal S3 delivered from the controller 50, outputting the remaining amount detection signal S5.

When the electric power generator 45 is not generating power, the output voltage V2 of the electric power storage means 90 gradually declines, and comes down below the standard value, 1.2 V, whereupon the remaining amount detection signal S5 turns to a low level, indicating insufficiency in the remaining amount of electric energy stored in the electric power storage means 90.

At this point in time, the timer 51 remains in the initialized condition, and both the output signal S12 therefrom and the power generation detection signal S4 are at a low level. Consequently, if the remaining amount detection signal S5 turns to a low level, the output signal S13 from the OR gate 53 turns to a low level as well, causing the control signal S8 outputted by the AND gate 54 to turn to a low level with the result that the watch driving system 80 stops operation of the time display system 82, suspending driving of the hands.

Meanwhile, at a point when the output voltage V2 of the electric power storage means 90 is slightly below 1.2 V, the remaining amount of electric energy in the electric power storage means 90 has a sufficient margin of safety before depletion, and is at a level sufficient for driving the watch driving system 80.

Now, operation of the electronic watch when generation of power is started with driving of the hands suspended is described hereinafter.

When a user wants to put the watch to use again after leaving same unused for a long time, external energy is supplied thereto such that the power generation device 46 within the electric power generator 45 is able to generate electric power.

In this embodiment, a difference in temperature between the opposite ends of the power generation device 46 is provided so as to cause the electric power generator 45 to generate electric power.

When power generation is started by the electric power generator 45, and the condition of the generated voltage V1 exceeding the given level (1.0 V) continues for a period longer than the delay time DT for detection of effective generation of power, the electric power generation detector 70 causes the power generation detection signal S4 to rise to a high level, performing the same operation as in the case of activating the electronic watch described hereinbefore so that the watch driving system 80 causes the time display sub-system 82 to start driving the hands.

Although no mention is made in explaining the case of activating the electronic watch as described hereinbefore, in case that the electric power generator 45 starts generation of power while the stored electric power detector 60 is detecting insufficiency in the remaining amount of electric energy, and the power generation detection signal S4 rises to a high level, the timer 51 starts timer operation, maintaining the output signal S12 therefrom at a high level for a given time T only.

As long as the output signal S12 from the timer 51 remains at a high level, the OR gate 53 turns the output signal S13 therefrom to a high level regardless of other inputs. That is, even if generation of power by the electric power generator 45 is stopped, turning the power generation detection signal S4 to a low level, this does not cause the output of the OR gate to fall suddenly while the output signal S12 from the timer 51 is at a high level.

Since output of the AND gate 54 remains at a high level if the output signal S13 of the OR gate 53 is at a high level, the control signal S8 remains at a high level for at least the given time T.

Accordingly, the control signal S8 remains at a high level for at least the given time T (standard time) once the electric power generation detector 70 has detected generation of power, and the watch driving system 80 can continue operation of time display (driving of the hands) by means of the time display sub-system 82 regardless of the power generation situation.

This is a case of power generation being resumed after time display has been out of operation. However, the time as displayed by the time display sub-system 82 differs from the proper time of day. Therefore, as with the case of an ordinary watch, a user sets the time on display with the proper time of day by pulling and turning the crown 84 shown in FIG. 6 so as to turn the short hand 87 and the long hand 88. The operation of time display by driving the hands is resumed by pushing in the crown 84 thereafter.

In this connection, only during a period when the crown 84 is pulled, the mechanical switch 85 causes the crown signal S7 to be at a low level. Accordingly, while operation of setting the time on display correct by pulling the crown 84 continues, the control signal S8 outputted from the AND gate 54 turns to a low level, and the watch driving system 80 suspends the operation of time display by driving the hands.

When the crown 84 is pushed in upon completion of the operation of correctly setting the time on display, the crown signal S7 rises to a high level, retriggering the timer 51 so that the timer 51 is reset, resuming timer operation for the given time T. Consequently, for the period of the given time T, the output signal S12 therefrom is at a high level.

As long as the output signal S12 from the timer 51 is at a high level, the output signal S13 from the OR gate 53 turns to a high level as well, turning the control signal S8 outputted from the AND gate 54 to a high level.

That is, for a period of at least the given time T after the crown 84 is pushed in, the operation of time display (driving of the hands) by the watch driving system 80 continues.

Thus, with the electronic watch according to the embodiment of the invention, even in case that same is left unused for a long time, the operation of time display (driving of the hands) is continued without interruption for at least a given time (for example, 5 minutes) after generation of power, or resumption of the operation of time display (driving of the hands) upon completion of the operation of correctly resetting the time on display.

Accordingly, if the electronic watch is placed in an environment enabling the electric power generator 45 to continue generation of power during that given time, the watch driving system 80 can continue stable operation of time display.

Further, if the operation of time display by the watch driving system 80 is suspended only when the amount of electric energy in the electric power storage means 90 comes down below the preset standard value, and electric energy generated by the electric power generator is below a given level (power is not generated), and also if the operation of time display is resumed not only after completion of the operation of correctly resetting the time but also when generation of electric energy at a given level or higher by the electric power generator 45 is detected by the electric power generation detector 70, frequency of or a length of duration for suspension of the operation of time display is reduced, enabling a more stabilized display of time.

Operation of the electronic watch when generation of power is resumed, as described hereinbefore, is effected by the remaining amount of electric energy in the electric power storage means 90, which, although insufficient, is capable of driving the watch driving system 80.

This is made possible because the remaining amount of electric energy in the electric power storage means 90 has not come down to a considerably low level although the watch has been left unused for a long time by saving consumption of power used by the electronic watch through suspension of at least the operation of time display by the watch driving system 80 as described in the foregoing, after the remaining amount of electric energy stored in the electric power storage means 90 has become insufficient.

In this embodiment, a monostable multivibrator with two inputs is employed for the timer 51. However, a similar timer may be composed more simply by connecting a plurality of flip-flop circuits in series. Further, for the power generation device 46 of the electric power generator 45, a thermoelectric power generation device is used. However, any type of power generator capable of generating power when a watch is worn may be used for the electric power generator 45.

In particular, a mechanical power generation type generator whereby mechanical energy of a rotary weight is converted into electric energy and is put to use, or a solar cell, may be used for the power generation device 46.

Further, although no mention has been made in the description of this embodiment, the electronic watch can be provided with a function of the time on display being automatically set to the present time when the suspended operation of time display is reactivated by combination of means for memorizing positions of display pointers of the time keeping means with means for receiving time information for acquiring external information on the standard time as with the case of an ordinary time correction type electronic watch.

In the third embodiment, the case of applying the invention to an analog type electronic watch is described by way of example. However, the invention is applicable to a digital electronic watch wherein a liquid crystal display is used for the time display sub-system 82. In such a case, a proper present time can be displayed immediately upon resumption of the operation of time display by keeping the crystal oscillator, frequency divider circuit, and time keeping counter, incorporated in the watch driving circuit 81, in operation.

Industrial Applicability

As described hereinbefore, with the electronic watch according to the invention, operation of time display at least is suspended when the remaining amount of the electric power storage means becomes insufficient but still has a margin of capacity enough to drive the watch driving system, the suspended operation of time display is resumed upon detecting start of generation of electric power, or by detecting conditions for reactivation such as operation of correctly setting the watch, and the reactivated operation of time display continues at least for a period when the preset condition is met (until a remaining amount of electric energy stored comes down to a predetermined level, or the elapse of a preset given time).

Accordingly, once the operation of time display is started when a user wears the electronic watch for use, the operation does not come to a stop quickly even if sufficient power is not generated thereafter, effecting stable display of an initial time, and stable display of time can continue without interruption if generation of sufficient power is started in the meantime, providing the user with a sense of security. Thus, reliability of the electronic watch with the built-in electric power generator is enhanced, resulting in appreciation in commercial value thereof.

What is claimed is:

1. An electronic watch comprising:

an electric power generator for generating electric energy by external energy;

electric power storage means for storing the electric energy generated by the electric power generator;

a watch driving system comprising a watch driving circuit and a time display sub-system, operated by electric energy supplied by the electric power storage means;

a stored electric power detector for detecting an amount of electric energy stored in the electric power storage means; and a controller whereby operation of at least the time display sub-system of the watch driving system is suspended when the amount of electric energy stored as detected by the stored electric power detector falls below a preset standard value, and thereafter, operation of the suspended portion of the watch driving system is resumed upon detecting conditions for reactivation, such operation being continued at least for a period when preset conditions are met;

said preset standard value having a margin of safety to enable the watch driving system to be driven for a short while.

2. An electronic watch according to claim 1, wherein the controller detects the conditions for reactivation by an action of the watch driving system wherein the time is set on display with the time of day.

3. An electronic watch according to claim 1, wherein until the elapse of a given time is among the preset conditions for continuing operation after the controller causes the suspended portion of the watch driving system to resume operation.

4. An electronic watch according to claim 1, wherein the preset conditions for continuing operation after the controller causes the suspended portion of the watch driving system to resume operation is until the amount of electric energy stored as detected by the stored electric power detector falls below a new standard value set below the preset standard value.

5. An electronic watch according to claim 1, wherein the controller is provided with means such that the standard value is set by selecting any value among a plurality of standard values at various levels so that when the amount of electric energy stored as detected by the stored electric power detector falls below a standard value set, the operation of at least the time display sub-system of the watch driving system is suspended, and upon detecting the conditions for reactivation, operation of the suspended portion of the watch driving system is resumed, changing the standard value to a standard value at a level lower by one level than the previously set level, and the resumed operation is continued until the amount of electric energy stored as detected by the stored electric power detector falls below a changed standard value, and when the amount of electric energy stored as detected exceeds a difference between a standard value at a level higher by one level than the changed standard value and the changed standard value by a given amount, the standard value being changed to a new standard value at a level higher by one level than the changed standard value.

6. An electronic watch comprising:

an electric power generator for generating electric energy by external energy;

electric power storage means for storing the electric energy generated by the electric power generator;

a watch driving system comprising a watch driving circuit and a time display sub-system operated by electric energy supplied by the electric power storage means;

an electric power generation detector for detecting a power generation condition of the electric power generator;

a stored electric power detector for detecting an amount of electric energy stored in the electric power storage means; and a controller whereby operation of at least the time display sub-system of the watch driving system is suspended when the amount of electric energy stored as detected by the stored electric power detector falls below a preset standard value, and when electric energy generated by the electric power generator as detected thereafter by the electric power generation detector is found to be at a given level or higher, operation of the suspended portion of the watch driving system is resumed, such operation being continued at least for a period when preset conditions are met;

said preset standard value having a margin of safety to enable the watch driving system to be driven for a short while.

7. An electronic watch comprising:

an electric power generator for generating electric energy by external energy;

electric power storage means for storing the electric energy generated by the electric power generator;

a watch driving system comprising a watch driving circuit and a time display sub-system, operated by electric energy supplied by the electric power storage means;

an electric power generation detector for detecting a power generation condition of the electric power generator;

a stored electric power detector for detecting an amount of electric energy stored in the electric power storage means; and a controller whereby operation of at least the time display sub-system of the watch driving system is suspended when the amount of electric energy stored as detected by the stored electric power detector falls below a preset standard value, and electric energy generated by the electric power generator as detected by the electric power generation detector is found to be at a given level or lower, and when electric energy generated by the electric pwoer generator as detected thereafter by the electric power generation detector is found to be at a given level or higher, operation of the suspended portion of the watch driving system is resumed, such operation being continued at least for a period when preset conditions are met;

said preset standard value having a margin of safety to enable the watch driving system to be driven for a short while.

8. An electronic watch according to claim 6, wherein the controller is provided with means whereby operation of the suspended portion of the watch driving system is resumed also when an action of the watch driving system setting a time on display with the time of day is detected.

9. An electronic watch according to claim 6, wherein until the elapse of a given time is among the preset conditions for continuing operation after the controller causes the suspended portion of the watch driving system to resume operation.

10. An electronic watch according to claim 6, wherein the preset condition for continuing operation after the controller causes the suspended part of the watch driving system to resume operation is until the amount of electric energy stored as detected by the stored electric power detector falls below a new standard value set below the preset standard value.

11. An electronic watch according to claim 6, wherein the controller comprises means for causing the time display sub-system of the watch driving system to set a time on display with the time of day when operation of the suspended portion of the watch driving system is resumed.

12. An electronic watch according to claim 7, wherein the controller is provided with means whereby operation of the suspended portion of the watch driving system is resumed also when an action of the watch driving system setting a time on display with the time of day is detected.

13. An electronic watch according to claim 7, wherein until the elapse of a given time is among the preset conditions for continuing operation after the control means causes the suspended portion of the watch driving system to resume operation.

14. An electronic watch according to claim 7, wherein the preset conditions for continuing operation after the controller causes the suspended portion of the watch driving system to resume operation is until the amount of electric energy stored as detected by the stored electric power detector falls below a new standard value set below the preset standard value.

15. An electronic watch according to claim 7, wherein the controller comprises means for causing the time display sub-system of the watch driving system to set a time on display with the time of day when operation of the suspended portion of the watch driving system to be resumed.

* * * * *